US005597325A

United States Patent [19]

Maejima et al.

[11] Patent Number: 5,597,325

[45] Date of Patent: Jan. 28, 1997

[54] DOUBLE-LOCK CONNECTOR

[75] Inventors: Toshiro Maejima; Yoshinori Uchida, both of Shizuoka, Japan

[73] Assignee: Yazaki Corporation, Tokyo, Japan

[21] Appl. No.: 590,448

[22] Filed: Jan. 23, 1996

[30] Foreign Application Priority Data

Jan. 31, 1995 [JP] Japan ..... 7-013469

[51] Int. Cl.[6] ..... H01R 13/40

[52] U.S. Cl. ..... 439/595

[58] Field of Search ..... 439/595, 752

[56] References Cited

FOREIGN PATENT DOCUMENTS

| | | | |
|---|---|---|---|
| 61-7875 | 1/1986 | Japan | H01R 13/422 |
| 62-171165 | 10/1987 | Japan | H01R 13/42 |
| 63-131074 | 8/1988 | Japan | H01R 13/42 |
| 1-64872 | 4/1989 | Japan | H01R 13/42 |
| 1-119176 | 8/1989 | Japan | H01R 13/42 |
| 1-117077 | 8/1989 | Japan | H01R 13/42 |
| 4-85686 | 7/1992 | Japan | H01R 43/20 |
| 4-78780 | 7/1992 | Japan | H01R 13/64 |
| 5-72063 | 9/1993 | Japan | H01R 13/42 |

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A inclined guide part which comprises an inclined surface for pushing up a spacer is formed in a connector housing and an inclined slide contact part is formed for the inclined guide part in the spacer an a position lower than the inclined guide part while the inclined surface for pushing down the flexible lock lance is formed at the tip of the antideflection plate. An up-face inclined guide surface for the spacer is formed on the rim of the opening of the connector housing. Temporary lock units are equipped in the connector housing and the spacer to temporarily hold the inclined guide part and the inclined slide contact part in their mutually proximate position.

4 Claims, 6 Drawing Sheets

DOUBLE-LOCK CONNECTOR

BACKGROUND OF THE INVENTION

The present invention relates to a double-lock connector where unlocking of a terminal locked by a locking lance inside a connector housing is enabled while a spacer for locking of the terminal is temporarily locked by the connector housing.

FIGS. 12 and 13 show a conventional double-lock connector appeared on Japan Utility Model Unexamined Publication No. Hei. 4-78780.

This double-lock connector 31 consists of a connector housing 33 which houses a terminal 32 and a front spacer 35 which is inserted into such connector housing 33 from the front and which prevents a flexible locking lance 34 from deflection inside the connector housing 33.

As shown in FIG. 13, an antideflection plate 36 on one side of such spacer 35 comprises an engagement hook 38 for a temporary lock projection 37 of the connector housing 33 and an antideflection plate 39 on the other side similarly comprises an engagement hook 41 for a true lock projection 40. The terminal 32 is drawn out by pressing down a flexible locking lance 34 with a stick jig 42 inserted into the connector housing 33 while the spacer 35 is temporarily locked as in shown in FIG. 12. This eliminates an operation to draw out the spacer each time and prevents possible damages on the spacer 35 during the operation.

The aforenamed conventional double lock connector 31, however, has a problem that the operation is inefficient since the flexible locking lance 34 needs to be pushed down manually with the stick jig 42 in a blind operation to unlock the terminal 32. Another problem is degradation of contact reliability of the terminal 32 caused by an operator who unintentionally thrusts the stick jig 42 into a contact part 43 of the terminal 32 by mistake.

SUMMARY OF THE INVENTION

With consideration of the above-described problems, an object of the present invention is to provide a double lock connector which eliminates the troublesome operation of fully pulling out a spacer and which enables ensured unlocking of the terminal without use of a stick jig.

To achieve the object described above, the double-lock connector of the present invention comprising a connector housing which comprises a flexible locking lance for a terminal and a spacer which comprises an antideflection plate for the flexible locking lance and which is to be inserted into the connector housing, has a basic structure where an inclined guide part which has an inclined surface for pushing up the spacer is formed in the connector housing, where an inclined slide contact part is formed, in the spacer, for the inclined guide part at a position lower than the inclined guide part and where an inclined surface is formed at the tip of the antideflection plate so as to push down the flexible locking lance.

Also, such structure is effective that an up-face inclined guide surface for the spacer is formed on the rim of the opening of the connector housing or that a temporary locking unit is formed in the connector housing and the spacer so as to temporarily hold the inclined guide part and the inclined slide contact part in their mutually proximate position.

The inclined guide part and the inclined slide contact part are positioned in their proximity in the temporary locking state of the spacer. The rear part of the spacer is pushed down in this state so that the front part of the spacer will be tilted high. This makes the inclined slide contact part positioned up-face to face the inclined guide part. Then, if the spacer is pushed up inclinatorily along the inclined guide surface in its inclined state, the antideflection part advances inclinatorily upward while the inclined guide part and the inclined slide contact part make a slide contact, and the inclined plane surface of the antideflection plate pushes down the flexible locking lance in its deflecting direction. This unlocks the terminal.

BRIEF DESCRIPTION OF THE DRAWINGS

FIG. 5 is a sectional view of the spacer being inclinatorily pushed in.

FIG. 9 is a longitudinal sectional view of the spacer inclinatorily pushed in.

DETAILED DESCRIPTION OF THE INVENTION

Preferred embodiments of the present invention will now be described with reference to the drawings.

Figure 1:
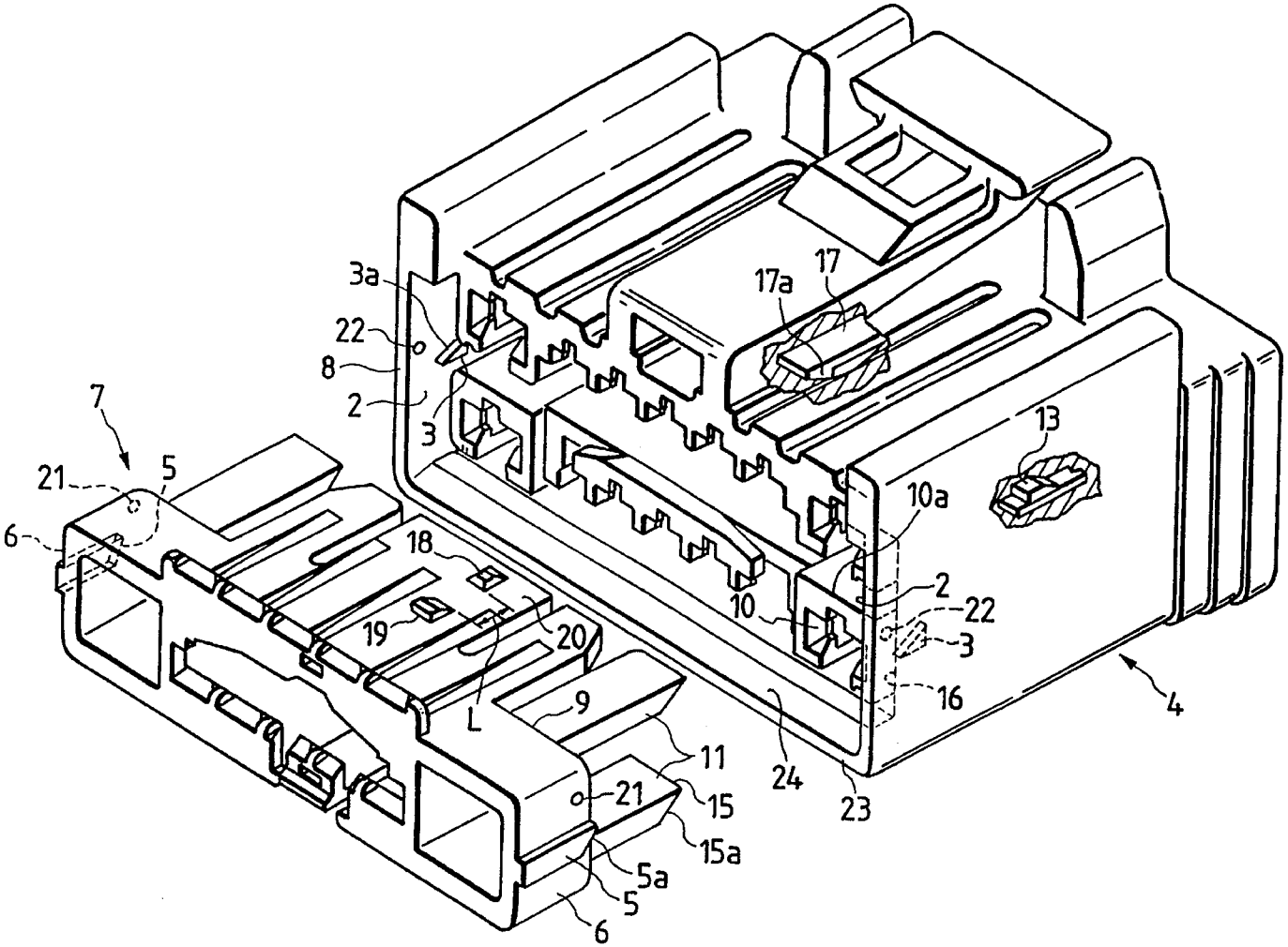
FIG. 1 is an exploded perspective view showing an embodiment of a double lock connector of the present invention.
Figure 2:
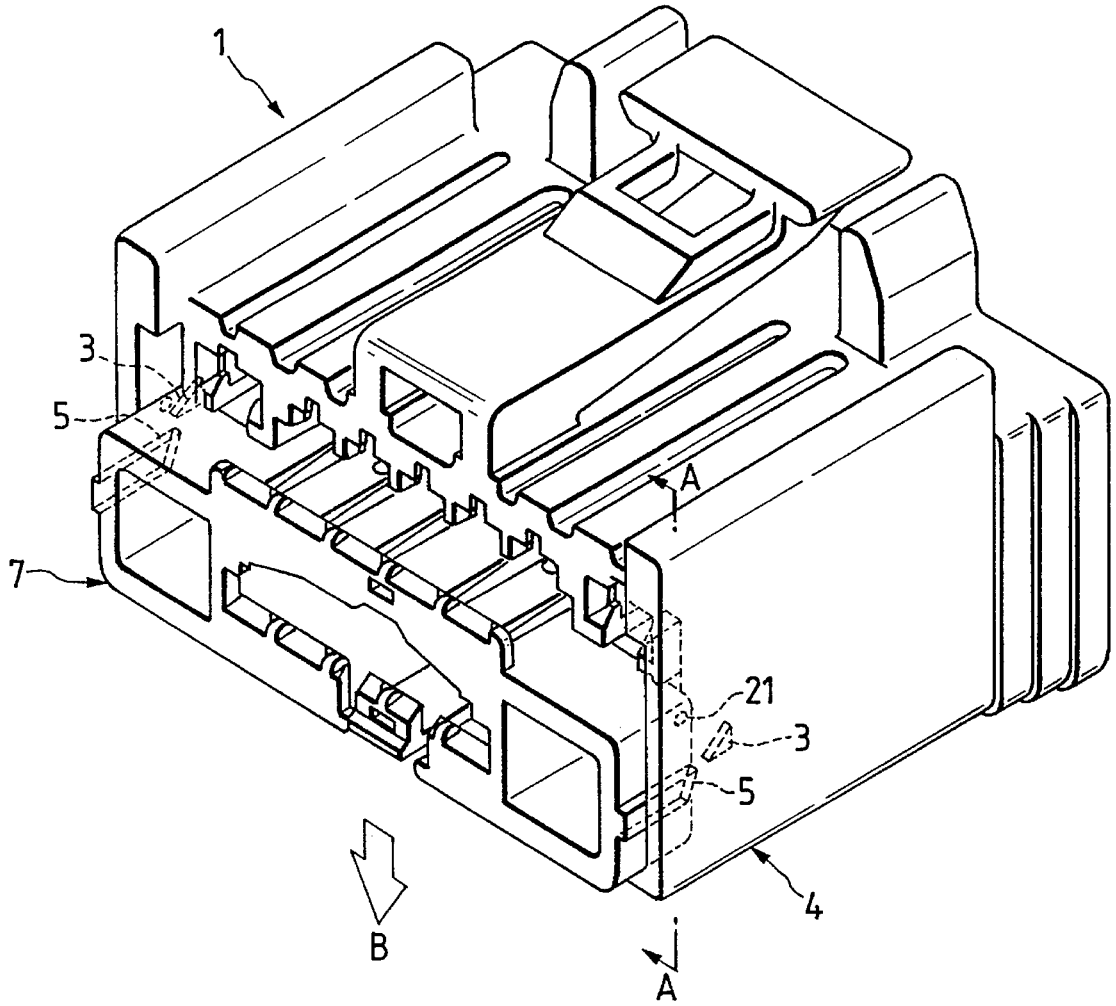
FIG. 2 is a perspective view showing a spacer of the connector in the temporary lock state.

FIGS. 1 and 2 show an embodiment of the double lock connector of the present invention.

A double lock connector 1 comprises a connector housing 4 which is made of synthetic resin and which comprises a pair of inclined guide projections 3 of a triangular shape on both inner side walls 2 and a front spacer 7 which is made of synthetic resin and which comprises a pair of inclined slide contact projections 5 for the inclined guide parts 3 on both outer side walls 6.

Each of the inclined guide projections 3 comprises an up-face inclined surface 3*a*, which faces an opening 8 of the connector housing 4, for pushing up the spacer. Each of the inclined slide contact projections 5 on the spacer side comprises a down-face inclined surface 5*a*, which confronts the up-face inclined surface 3*a* of the inclined guide projection 3. The inclined slide contact projections 5 are formed horizontally in the direction of spacer insertion on the center of the outer side walls 6 of the spacer 7 and the down-face inclined surface 5*a* is located close to the front end of a frame part 9 of the spacer 7. Inclination angles of the up-face inclined surface 3*a* and the down-face inclined surface 5*a* are set up almost the same. The inclined slide contact projections 5 are located proximate to the lower side of the inclined guide projections 3 at the time of spacer insertion.

Figure 6:
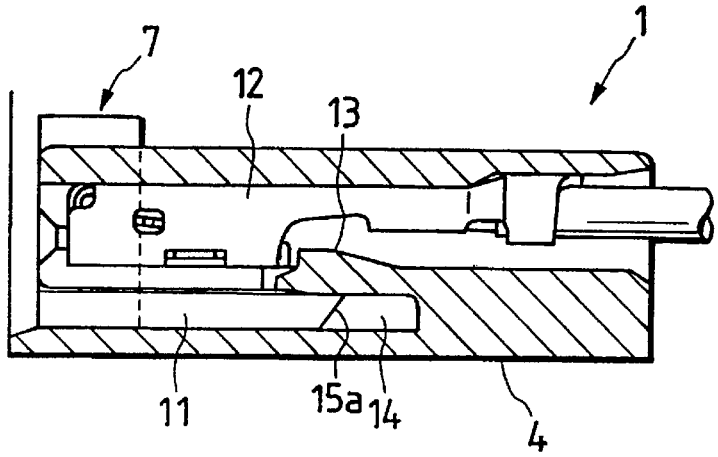
FIG. 6 is a longitudinal sectional view of the spacer in the true lock state.

More than one antideflection plate 11 which is to be inserted into the lower side of a terminal containing chamber 10 of the connector housing 4 protrudes from the spacer 7. The antideflection plates 11, as shown in FIG. 6, are to be inserted into a deflection space 14 for a flexible locking lance 13 in the connector housing 4 for a terminal 12. A wedge part 15 which comprises a down-face inclined surface 15*a* is formed at each end of the antideflection plates 11.

In this embodiment, the terminal containing chambers 10 of upper and lower two stages are formed in the connector housing 4 and, so as to correspond these, the antideflection plates 11 are formed in upper and lower two rows in the spacer 7. A spacer insertion space 16 is formed around a terminal containing part 10*a*. The antideflection plates 11 protrude from the frame part 9 toward the front, and the inclined slide contact projections 5 are formed respectively on the outer side walls 6.

A lock plate 20, which comprises a temporary lock projection 18 and a true lock projection 19 that are to engage with a flexible lock piece 17 inside the connector housing 4, protrudes from the upper part of the frame part 9. The temporary lock projection 18 is located in a front position of inserting direction of the lock plate 20 and the true lock projection 19 is located behind the temporary lock projection 18. Distance L between the temporary lock projection 18 and the true lock projection 19 is set so as to be equal to advancing distance L of the spacer 7 toward the flexible locking lance 13 as described below with reference to FIGS. 8 through 10.

A small temporary lock projection 21 is formed above the inclined slide contact projection 5 in the vicinity of front end of the outer side wall 6 of the spacer 7 and a shallow engagement hole 22 for the small temporary lock projection 21 is formed on the inner side wall 2 of the connector housing 4. The engagement hole 22 is located at a front position of the inclined guide projection 3.

An up-face inclined guide surface 24 is formed on the rim of the opening of a bottom wall 23 of the connector housing 4. The inclined guide surface 24 functions as a guide to tilt the spacer 7 inclinatorily upward. The inclination angle of the inclined guide surface 24 is set to be almost the same as the inclination angle of the inclined surface 3*a* of the inclined guide projection 3.

FIG. 2 shows the spacer 7 temporarily locked to the connector housing 4, and the temporary lock projection 18 of the spacer 7 shown in FIG. 1 is inserted beyond a hook part 17*a* of the flexible lock piece 17 of the connector housing 4 and the spacer 7 is temporarily held when the small temporary lock projection 21 engages with the engagement hole 22. This temporary holding force is extremely small.

Figure 3:
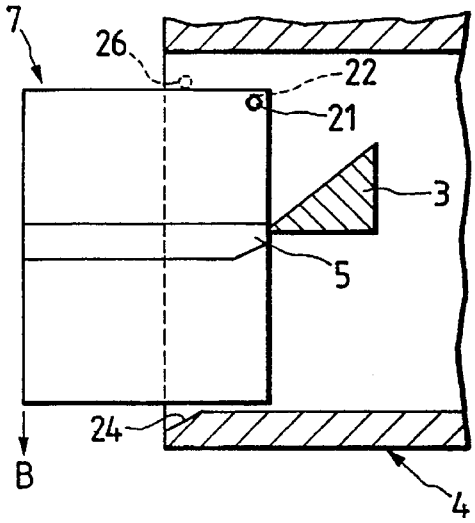
FIG. 3 is a sectional view at A—A in FIG. 2.
Figure 4:
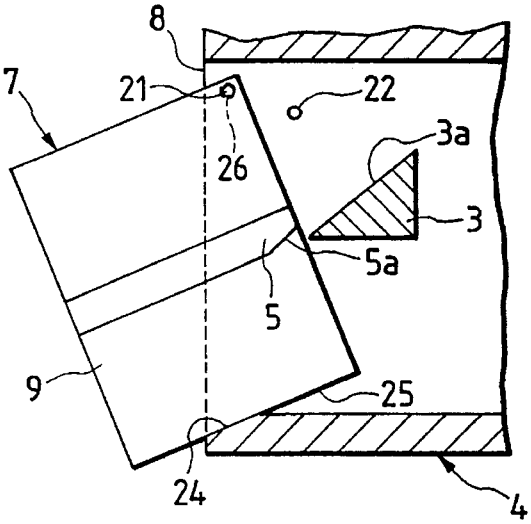
FIG. 4 is a sectional view of the spacer in the inclined state.

As shown in FIG. 3, the inclined slide contact projection 5 of the spacer 7 is positioned in the proximity of the front lower side of the inclined guide projection 3 of the connector housing 4 in this temporary lock state. In this state, the spacer 7 is pushed slantingly down by hand in direction B and then, as shown in FIG. 4, a bottom wall 25 of the frame part 9 is made contact with the inclined guide surface 24 of the housing opening 8. A second engagement hole 26 may be formed in a position above the connector housing 4, as shown in FIG. 3, to engage with the small temporary lock projection 21 in this state.

Figure 5:
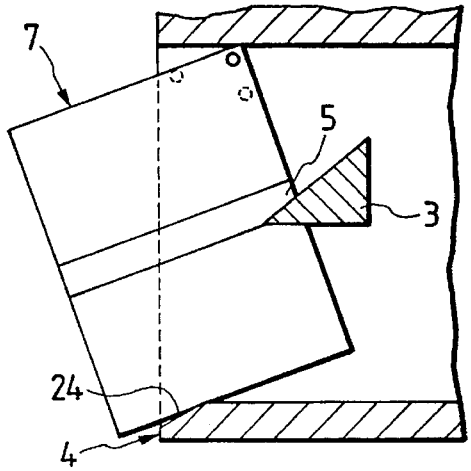
Figure 8:
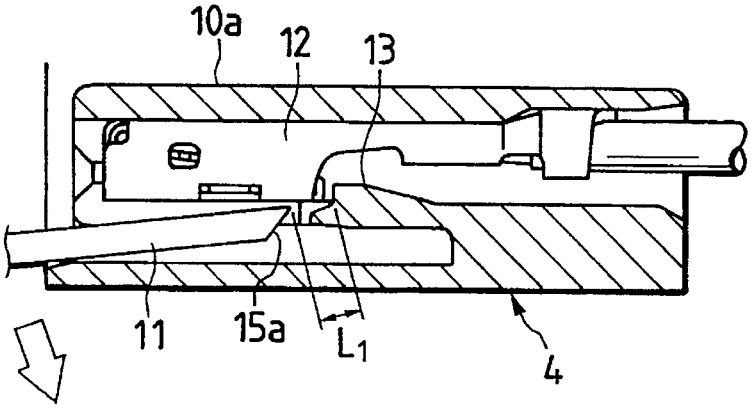
FIG. 8 is a longitudinal sectional view showing the spacer in the inclined state.
Figure 9:
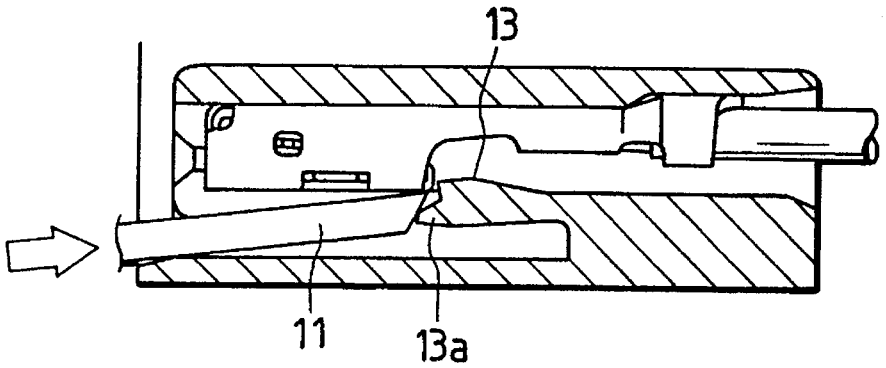
Figure 10:
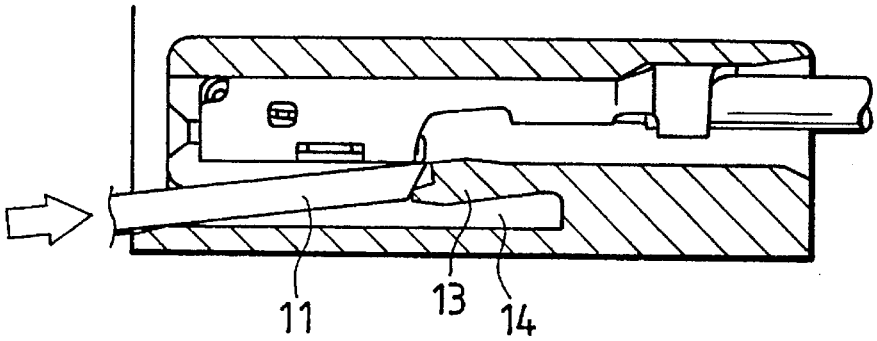
FIG. 10 is a longitudinal sectional view showing the locking lance being pushed down by the antideflection plate.
Figure 11:
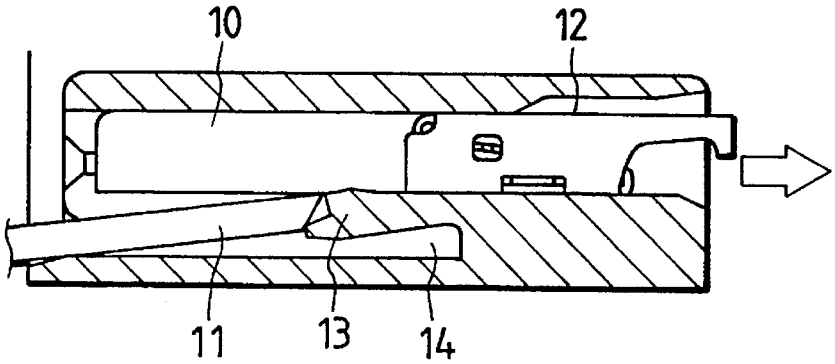
FIG. 11 is a longitudinal sectional view of the spacer being drawn out.
Figure 12:
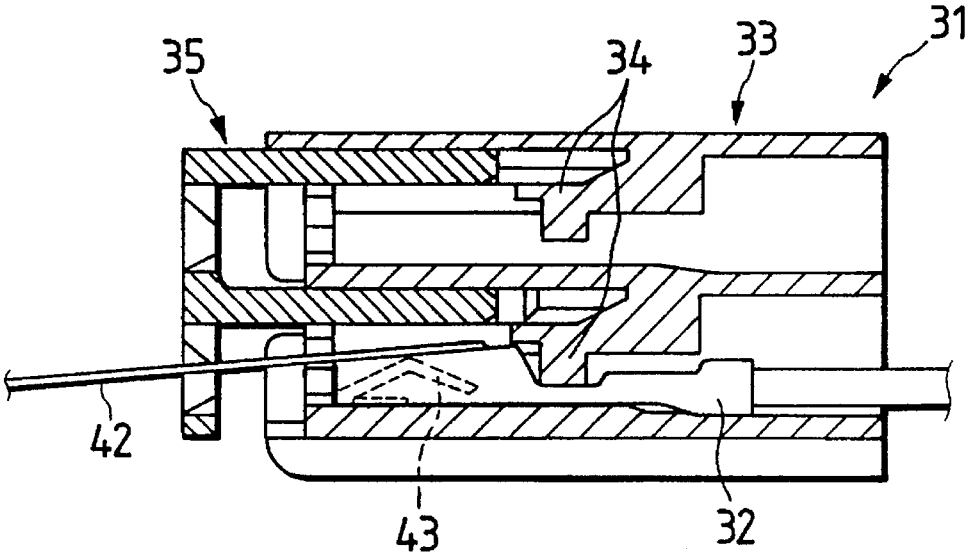
FIG. 12 PRIOR ART
FIG. 12 is a longitudinal sectional view showing a conventional double lock connector.
Figure 13:
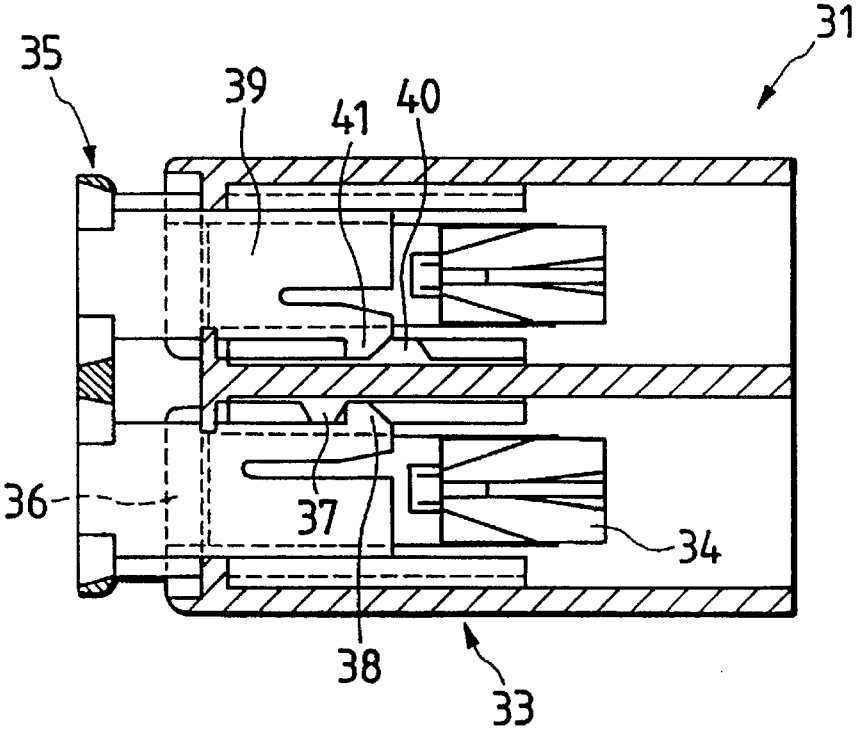
FIG. 13 PRIOR ART
FIG. 13 is a cross sectional view of the conventional connector.

Next, as shown in FIG. 5, the spacer 7 is slid inclinatorily upward along the guide surface 24, and the down-face inclined surface 5*a* of the inclined slide contact projection 5 of the spacer 7 is moved along the up-face inclined surface 3*a* of the inclined guide projection 3 of the housing 4. This operation makes the antideflection plates 11 of the spacer 7 advance inclinatorily upward as shown in FIGS. 8 through 10, the down-face inclined surface 15*a* at the tip of the antideflection plate 11 makes a sliding contact with a tip 13*a* of the flexible locking lance 13 of the connector housing 4, and the locking lance 13 is pushed into the deflection space 14. As a result, as shown in FIG. 11, the terminal 12 is drawn backward out of the terminal containing chamber 10.

Figure 7:
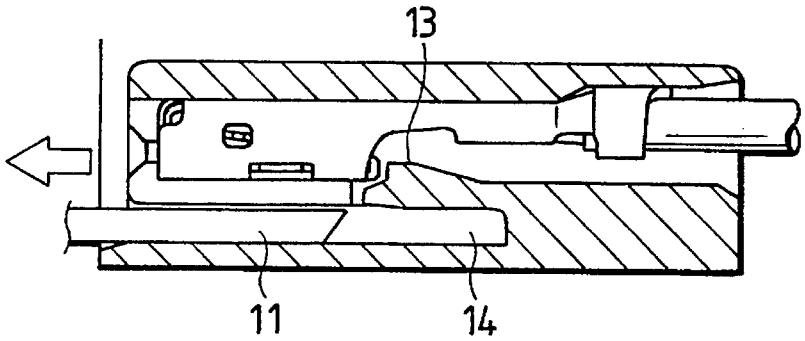
FIG. 7 is a longitudinal sectional view showing the movement of the antideflection plate while the spacer is in the temporary lock state.

FIG. 6 shows the spacer 7 truly locked to the connector housing 4 and FIG. 7 shows the spacer 7 drawn out of the true lock state and now in the temporary lock state. The antideflection plate 11 of the spacer 7 is positioned inside the deflection space 14 of the flexible locking lance 13 in the true lock state, and the antideflection plate 11 is positioned outside the deflection space 14 and on the proximate lower front side of the flexible locking lance 13 in the temporary lock state. Advancing movement of the antideflection plate 11 from the state in FIG. 7 to the state in FIG. 10 is enabled by free travelling of the hook part 17*a* of the flexible lock piece 17 between the temporary lock projection 18 and the true lock projection 19.

As described above, according to the present invention, unlocking of the terminal locked by the flexible locking lance is enabled by inclinatorily pushing up the spacer in the temporary lock state. This facilitates simple and ensured unlocking of the terminal without using a stick jig as in the prior art and further without drawing out the spacer. Further, this eliminates troubles such as deformation of the terminal by the stick jig.

What is claimed is:

1. A double-lock connector, comprising:

a connector housing including a flexible locking lance for a terminal; and a spacer including an antideflection plate for said flexible locking lance, said spacer being to be inserted into said connector housing;

wherein said connector housing comprises an inclined guide part including an inclined surface for pushing up said spacer;

wherein said spacer comprises an inclined slide contact part for said inclined guide part, said inclined slide contact part being located lower than said inclined guide part; and wherein said antideflection plate includes an inclined surface, at a tip of said antideflection plate, for pushing down said flexible locking lance.

2. A double-lock connector claimed in claim 1, wherein said connector housing comprises, at a rim of an opening of said connector housing, an up-face inclined guide surface for said spacer.

3. A double-lock connector as claimed in claim 1, wherein said connector housing and said spacer comprise temporary locking means for temporarily holding said inclined guide part and said inclined slide contact part in their mutually proximate position.

4. A double-lock connector as claimed in claim 2, wherein said connector housing and said spacer comprise temporary locking means for temporarily holding said inclined guide part and said inclined slide contact part in their mutually proximate position.

* * * * *